US012031552B2

(12) United States Patent
Zhao et al.

(10) Patent No.: US 12,031,552 B2
(45) Date of Patent: Jul. 9, 2024

(54) COMPRESSOR

(71) Applicant: Wuxi Cummins Turbo Technologies Company Ltd., Jiangsu (CN)

(72) Inventors: Wentao Zhao, Jiangsu (CN); Zhao Cao, Jiangsu (CN)

(73) Assignee: WUXI CUMMINS TURBO TECHNOLOGIES COMPANY LTD., Jiangsu (CN)

( * ) Notice: Subject to any disclaimer, the term of this patent is extended or adjusted under 35 U.S.C. 154(b) by 106 days.

(21) Appl. No.: 17/604,193

(22) PCT Filed: Apr. 15, 2020

(86) PCT No.: PCT/CN2020/084985
§ 371 (c)(1),
(2) Date: Oct. 15, 2021

(87) PCT Pub. No.: WO2020/211788
PCT Pub. Date: Oct. 22, 2020

(65) Prior Publication Data

US 2022/0196036 A1 Jun. 23, 2022

(30) Foreign Application Priority Data

Apr. 15, 2019 (CN) ..... 201910297244.3
Apr. 15, 2019 (CN) ..... 201920500212.4

(51) Int. Cl.
*F04D 29/66* (2006.01)
*F04D 29/42* (2006.01)

(52) U.S. Cl.
CPC ..... *F04D 29/663* (2013.01); *F04D 29/4206* (2013.01)

(58) Field of Classification Search
CPC ... F04D 29/663; F04D 29/665; F04D 29/4206
See application file for complete search history.

(56) References Cited

U.S. PATENT DOCUMENTS 9,816,524 B2 11/2017 Tamaki
10,364,825 B2 * 7/2019 Bessho ..... F04D 29/4206
11,105,218 B2 8/2021 Karstadt et al.
2010/0098532 A1 * 4/2010 Diemer ..... F04D 29/685 29/889.22

(Continued)

FOREIGN PATENT DOCUMENTS

CN 101583800 A 11/2009
CN 201582209 U 9/2010

(Continued)

OTHER PUBLICATIONS

International Search and Written Opinion issued by the National Intellectual Property Administration, PRC, dated Jul. 20, 2020, for International Application No. PCT/CN2020/084985; 9 pages.

*Primary Examiner* — Sabbir Hasan
(74) *Attorney, Agent, or Firm* — Faegre Drinker Biddle & Reath LLP

(57) ABSTRACT

A compressor, for use alone or as a component part of a turbocharger. The compressor comprises a compressor housing and a compressor wheel mounted in the compressor housing. An internal surface of the compressor housing defines an axial inlet. The axial inlet comprises an annular groove for reducing compressor noise.

20 Claims, 4 Drawing Sheets

(56) References Cited

U.S. PATENT DOCUMENTS

2016/0258447 A1 9/2016 Day et al.

FOREIGN PATENT DOCUMENTS

| | | | |
|---|---|---|---|
| CN | 104053911 | A | 9/2014 |
| CN | 205025820 | U | 2/2016 |
| CN | 105683524 | A2 | 6/2016 |
| CN | 105909562 | A | 8/2016 |
| CN | 106133291 | U | 11/2016 |
| CN | 208221189 | U | 12/2018 |
| CN | 109416056 | A | 3/2019 |
| CN | 109899321 | A | 6/2019 |
| CN | 210152976 | U | 3/2020 |
| GB | 1283710 | A | 8/1972 |
| WO | 2015175234 | A1 | 11/2015 |

* cited by examiner

COMPRESSOR

CROSS-REFERENCE TO RELATED APPLICATIONS

The present application is a national stage application of International (PCT) Patent Application Serial No. PCT/CN2020/084985, filed on May 15, 2020, which claims priority to Chinese Patent Application No. 201910297244.3, filed Apr. 15, 2015 and Chinese Patent Application No. 201920500212.4, filed Apr. 15, 2019, the complete disclosures of which are expressly incorporated by reference herein.

FIELD

The present disclosure relates to compressors, particularly but not exclusively, compressors for use in turbochargers.

BACKGROUND

As shown in FIG. 1, a compressor 10 comprises a compressor wheel 12 (or "impeller"), having a plurality of blades 14 mounted on a shaft 16 for rotation within a compressor housing 18. The compressor housing 18 defines an axial inlet 22. The shaft 16 and the axial inlet 22 are axially aligned. The compressor housing 18 also defines a radially-extending diffuser 26 and a volute 24, both arranged annularly around the axial inlet 22. The diffuser 26 and the volute 24 are arranged concentrically, the diffuser 26 radially inboard of the volute 24. The volute 24 is in gas flow communication with a compressor outlet. The rotation of the compressor wheel 12 draws intake air through the axial inlet 22 and delivers compressed air to a component connected to the compressor outlet via the diffuser 26 and the volute 24.

One use of a compressor is in a turbocharger. Turbochargers are well known devices for supplying air to the intake of an internal combustion engine at pressures above atmospheric pressure (boost pressures). A conventional turbocharger comprises an exhaust gas driven turbine wheel connected downstream of an engine outlet manifold, and mounted on a rotatable shaft. A compressor wheel is mounted on the opposite end of the shaft such that rotation of the turbine wheel, driven by exhaust gasses from the engine outlet manifold, translates to rotation of the compressor wheel. In this application of a compressor, the compressor wheel delivers compressed air to an engine intake manifold.

Referring again to FIG. 1, each blade 14 extends from a root 36, attached to a hub 38 of the impeller 12, to a tip 34. Each blade 14 has a leading edge 40 which rotates, in use, within the axial inlet 22 and a trailing edge 42 which rotates, in use, at the entrance to the diffuser 26. The tip 34 of each blade 14 is curved and joins the leading edge 40 and the trailing edge 42. In use, the tip 34 of each blade 14 sweeps across an intermediate surface 44 of the compressor housing 18, the intermediate surface 44 defined between the axial inlet 22 and the diffuser 26. The intermediate surface 44 and the tip 34 of each blade 14 have complementary curved shapes.

The axial inlet 22 has a nozzle portion 22*a* and a duct portion 22*b*. The duct portion 22*b* is axially inboard of the nozzle portion 22*a*. The nozzle portion 22*a* connects to the duct portion 22*b* at point 45.

Acoustic pressure waves are generated as air flows through the compressor 10. The amplitude of the generated acoustic pressure waves is dependent on the blade-pass frequency. There are other frequencies that affect the amplitude of acoustic pressure waves generated, however blade-pass frequency is a dominating factor. Blade-pass frequency occurs due to the flow interaction between the rotating impeller 12 and the stationary compressor housing 18. The blade-pass frequency varies with the rotational frequency of the impeller 12 and the number of blades 14. Blade pass frequency often produces a noise which can be particularly aggravating to people in the vicinity of the compressor 10.

The inlet air flow is commonly substantially uniform across the cross-sectional profile of the axial inlet 22, therefore all of the acoustic pressure waves generated within the compressor 10 are substantially in phase with each other. The superposition of these in-phase acoustic pressure waves results in an increased amplitude and therefore increased intensity of blade-pass noise.

It is known that positioning noise reduction measures at the side of the compressor 10 exposed to atmospheric air pressure, i.e. the inlet, is the most efficient way to reduce blade-pass noise. Intake silencers (absorptive or dissipative) can be fitted to the axial inlet 22, external to the compressor housing 18, to reduce the intensity of blade-pass noise. Intake silencers generally comprise absorptive material and/or a perforated tube, and an exterior shell. Inlet silencers can be expensive and generally require a lot of additional space.

It is an object of the present disclosure to obviate or mitigate one or more of the problems set out above.

SUMMARY

According to a first aspect there is provided a compressor. The compressor comprises a housing and a wheel mounted in the housing. An internal surface of the housing defines an axial inlet. The axial inlet comprises an annular groove for reducing compressor noise.

The groove in the axial inlet is easy to manufacture using machine tools, and therefore is a cheap feature to include in a compressor.

In an embodiment, the groove may have a depth that is less than the distance between the internal surface of the housing defining the axial inlet and an external surface of the housing opposing the internal surface.

In an embodiment, the groove may have a constant profile around its circumference. In an alternative embodiment the groove may have a variable profile around its circumference. The depth of the groove may be constant or may vary around its circumference.

In an embodiment, the groove may comprise an inlet. The groove inlet may be radially aligned with the internal surface of the housing.

In an embodiment, the groove may have a rectangular profile. The rectangular profile may be defined by the groove inlet, a closed end surface, and axially opposing sidewalls. A corner between the internal surface of the housing and each sidewall of the groove may be curved. A corner between each sidewall and the closed end surface may be curved.

In an embodiment, the dimensions of the groove may be defined by the equation:

$$IL = 10 \log \frac{\left(\frac{s_B}{2S}\right)^2 + (cotkL)^2}{(cotkL)^2}$$

IL is the reduction in compressor noise, $S_b$ is the area of the groove inlet, S is a cross-sectional area of the axial inlet, L is the depth of the groove, k is a factor calculated by $$k = \frac{\omega}{c}$$

where ω is the frequency of the sound waves in the compressor in use and c is the acoustic speed of the sound waves in the compressor in use. An average reduction in compressor noise may be approximately 1 to 8 dB, 2 to 6 dB or approximately 4 dB.

In an embodiment, the housing may define an inlet port to the axial inlet. The groove may be located between the inlet port and the compressor wheel.

In an embodiment, the compressor wheel may comprise an inducer end. The groove may be located between the inlet port and the inducer end of the compressor wheel.

In an embodiment, the axial inlet may comprise a nozzle portion and a duct portion. The groove may be located in the duct portion. The nozzle portion may be located between the inlet port and the duct portion.

In an embodiment, the axial inlet may comprise at least one further groove in the axial inlet. The or each further groove may have the same configuration as the annular groove or may have a different configuration.

According to a second aspect there is provided a turbocharger comprising a turbine mounted on a first end of a shaft and a compressor according to any embodiment of the first aspect. The compressor wheel is mounted on a second end of the shaft opposing the first end of the shaft.

According to a third aspect there is provided a compressor housing defining an axial inlet. An internal surface of the axial inlet comprises an annular groove for reducing compressor noise.

BRIEF DESCRIPTION OF FIGURES

The disclosure will now be described, by way of example only, with reference to the accompanying drawings in which.

DETAILED DESCRIPTION

Figure 1:
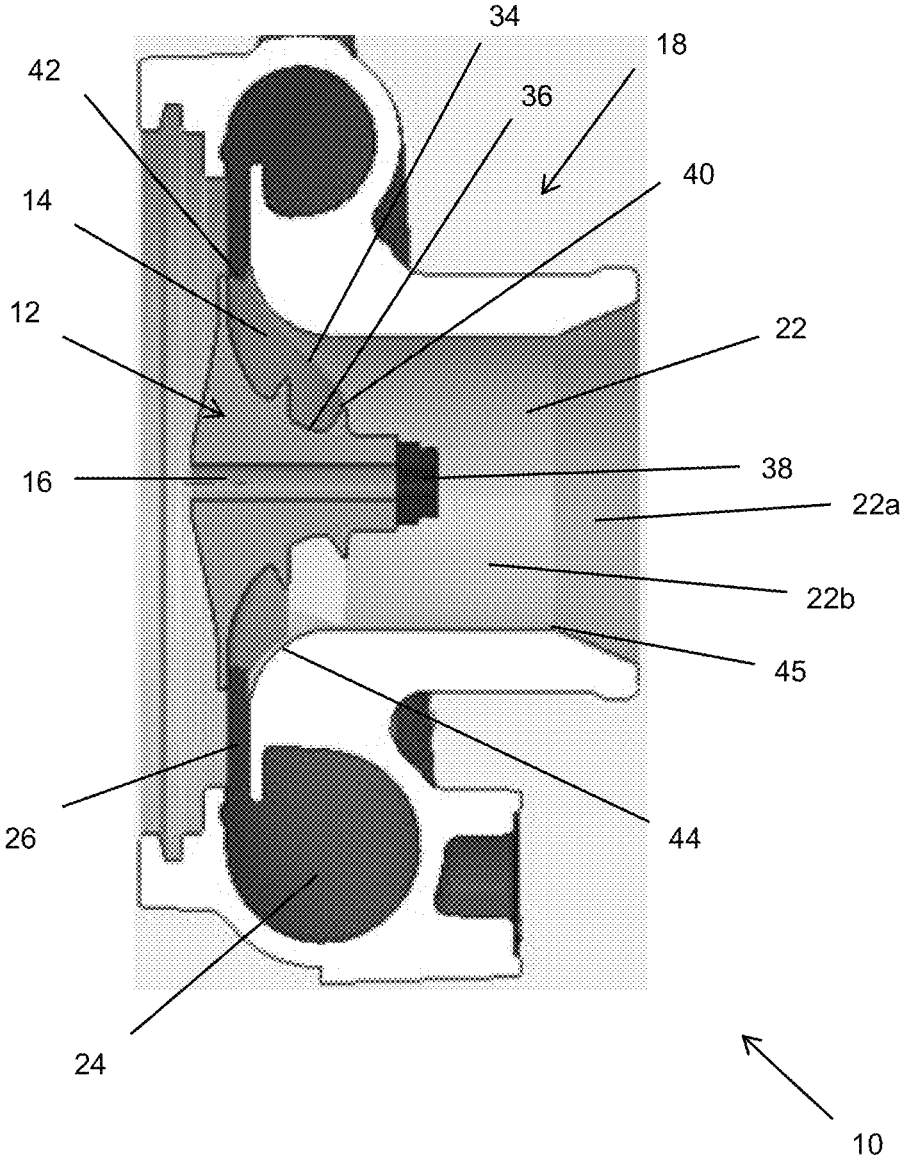
Figure 1 (prior art)
FIG. 1 is a section elevation of a known compressor.

In reference to FIG. 2, there is a compressor, similar to that described above in relation to FIG. 1, the additional features of which will be described herein. Like features have been provided with like reference numerals, increased by 100.

The housing 118 has an inlet port 132. The axial inlet 122 is defined by a radially inner surface 128 of the housing 118 that extends axially inboard from the inlet port 132. The axial inlet 122 has a nozzle portion 122*a* and a duct portion 122*b*. The duct portion 122*b* is axially inboard of the nozzle portion 122*a*. The diameter of the radially inner surface 128 defining the nozzle portion 122*a* of the axial inlet 122 reduces linearly along its axial length axially inboard of the inlet port 132. The diameter of the radially inner surface 128 defining the duct portion 122*b* of the axial inlet 122 is substantially constant along its axial length. In other embodiments, the axial inlet 122 only has a duct portion, such that the radially inner surface 128 defining the axial inlet 122 has a constant diameter along its entire axial length.

The axial inlet 122 includes a groove 150. In use the groove 150 acts as a side branch resonator to attenuate sound in the compressor 110. The groove 150 disturbs the otherwise uniform airflow through the axial inlet 122 to create a portion of inlet air flow with a sound wave propagation path that is out of phase with the sound wave propagation path of the normal inlet air flow. Optimally, the groove 150 results in the sound wave propagation path of the disturbed air flow being out of phase with the sound wave propagation path of the normal air flow by half a wavelength. This provides the maximum reduction in amplitude of the superposed sound waves.

The groove 150 is located between inlet port 132 and an inducer end 139 of the impeller hub 138. The groove 150 is located in the duct portion 122*b* of the axial inlet 122. The groove 150 is generally annular and extends around the full circumference of the axial inlet 122. The groove 150 has a diameter greater than the diameter of the radially inner surface 128 of the housing 118 in the duct portion 122*b* of the axial inlet 122, and the groove 150 has a diameter less than the diameter of a radially outer surface 129 of the housing 118 opposing the radially inner surface 128. Therefore the groove 150 has a depth L that is less than a thickness of the housing 118 between the radially inner surface 128 and the radially outer surface 129 of the housing 118. The groove 150 has an axial length h less than the axial length of the axial inlet 122. The groove 150 has an axial length h less than the axial length of the duct portion 122*b* of the axial inlet 122. The axial length h of the groove 150 is less than the axial distance x between the point 145 at which the nozzle portion 122*a* connects to the duct portion 122*b*, and the inducer end 139 of the impeller hub 138. In other embodiments, the axial length of the groove 150 may be approximately the same as the axial distance x between the point 145 at which the nozzle portion connects to the duct portion, and the inducer end 139 of the impeller hub 138. In further embodiments, the groove 150 has an axial length that is any appropriate length up to around 140 mm. In further embodiments, the axial length of the groove 150 is around 5 mm to 45 mm, optionally greater than around 5 mm and less than around 15 mm, for example, around 10 mm, or greater than 30 mm and less than 45 mm, for example, around 42 mm, e.g. 41.65 mm.

Figure 3:
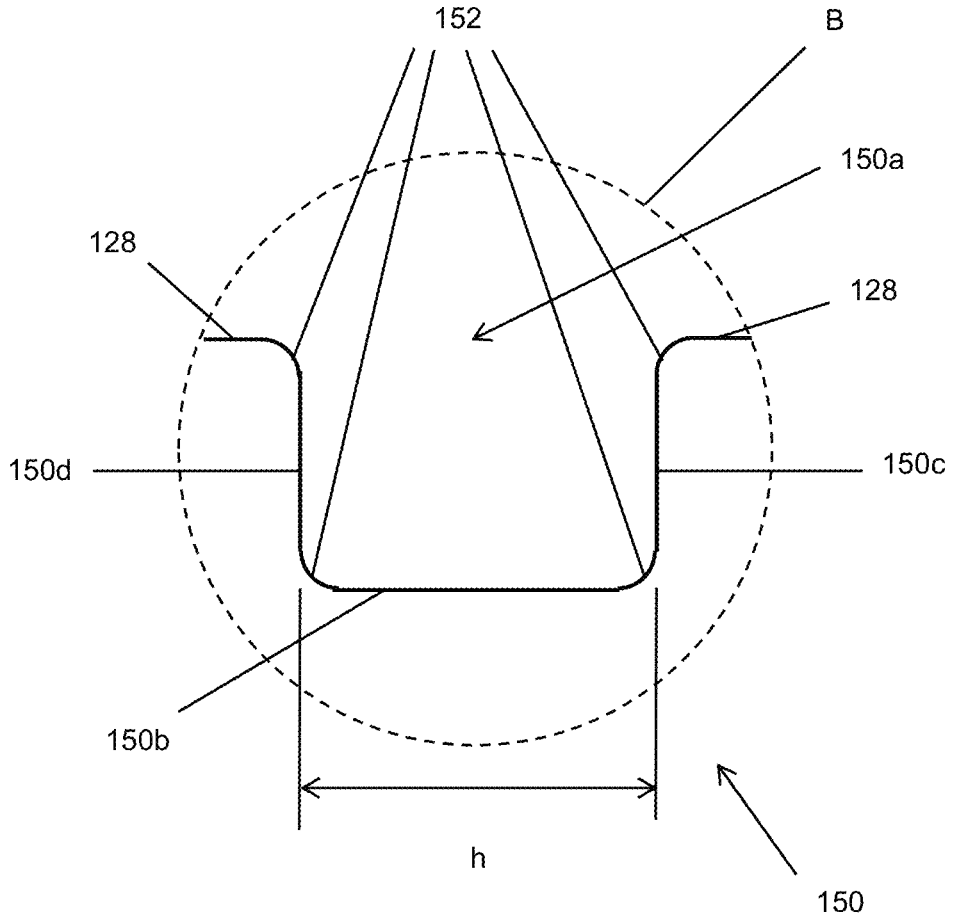
FIG. 3 is a detail view of the groove, indicated at B in FIG. 2.

As shown in FIG. 3 the groove 150 is rectangular in profile. The groove 150 has an inlet 150*a*, a closed end surface 150*b* and sidewalls 150*c* and 150*d*. Corners 152 of the groove 150, between the radially inner surface 128 of the housing 118 and the sidewalls 150*c* and 150*d*, and between the sidewalls 150*c* and 150*d* and the closed end surface 150*b*, are curved. The radius of the curved corners 152 is sized appropriately with regard to the dimensions of the groove 150, to provide optimal sound reduction. In the embodiment shown, the profile of the groove 150 is uniform around its circumference. Alternatively, in other embodiments, the groove 150 may vary in profile around the circumference. The groove 150 may vary in depth L, axial length h or shape around the circumference.

Figure 2:
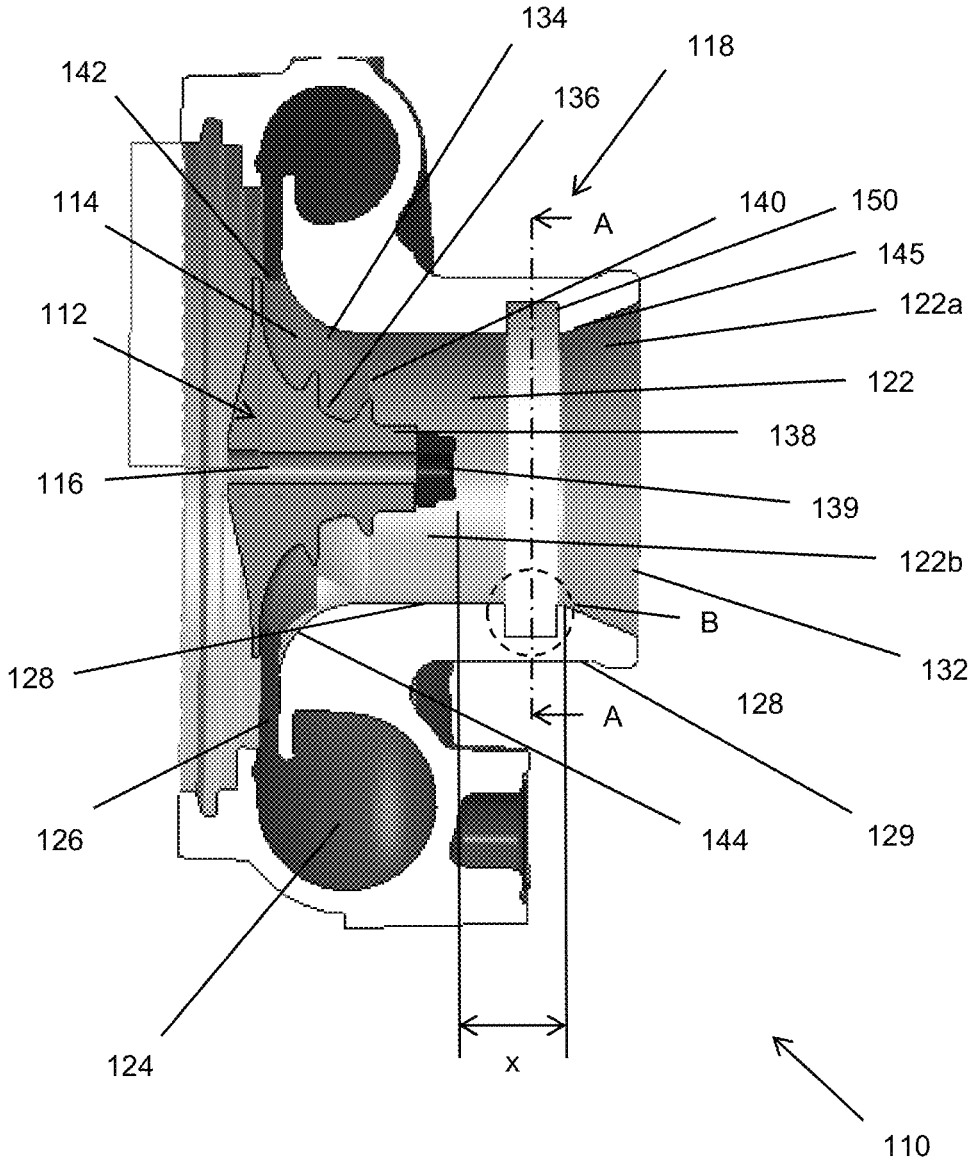
FIG. 2 is a section elevation of a compressor according to the present disclosure.

As shown in FIG. 2 there is a single groove 150 in the inlet passage. In other embodiments there may be a plurality of grooves in the inlet passage, for example there may be 2 grooves, 3 grooves, 4 grooves, or more. Each groove may have the same profile, or each groove may have a different profile.

The reduction in blade-pass noise in a compressor 110 with a groove 150 according to the present disclosure, compared to a compressor 10 without a groove and therefore not in accordance with the present disclosure, is the "insertion loss". The insertion loss is calculated using the principles of a quarter-wave resonator. Normally, a quarter-wave resonator comprises a side duct connected to a main duct to form a t-shape, with air flow through the main duct. The insertion loss in a quarter-wave resonator is calculated by the quarter-wave equation:

$$IL = 10\log\frac{\left(\frac{S_B}{2S}\right)^2 + (cotkL)^2}{(cotkL)^2}$$

Figure 4:
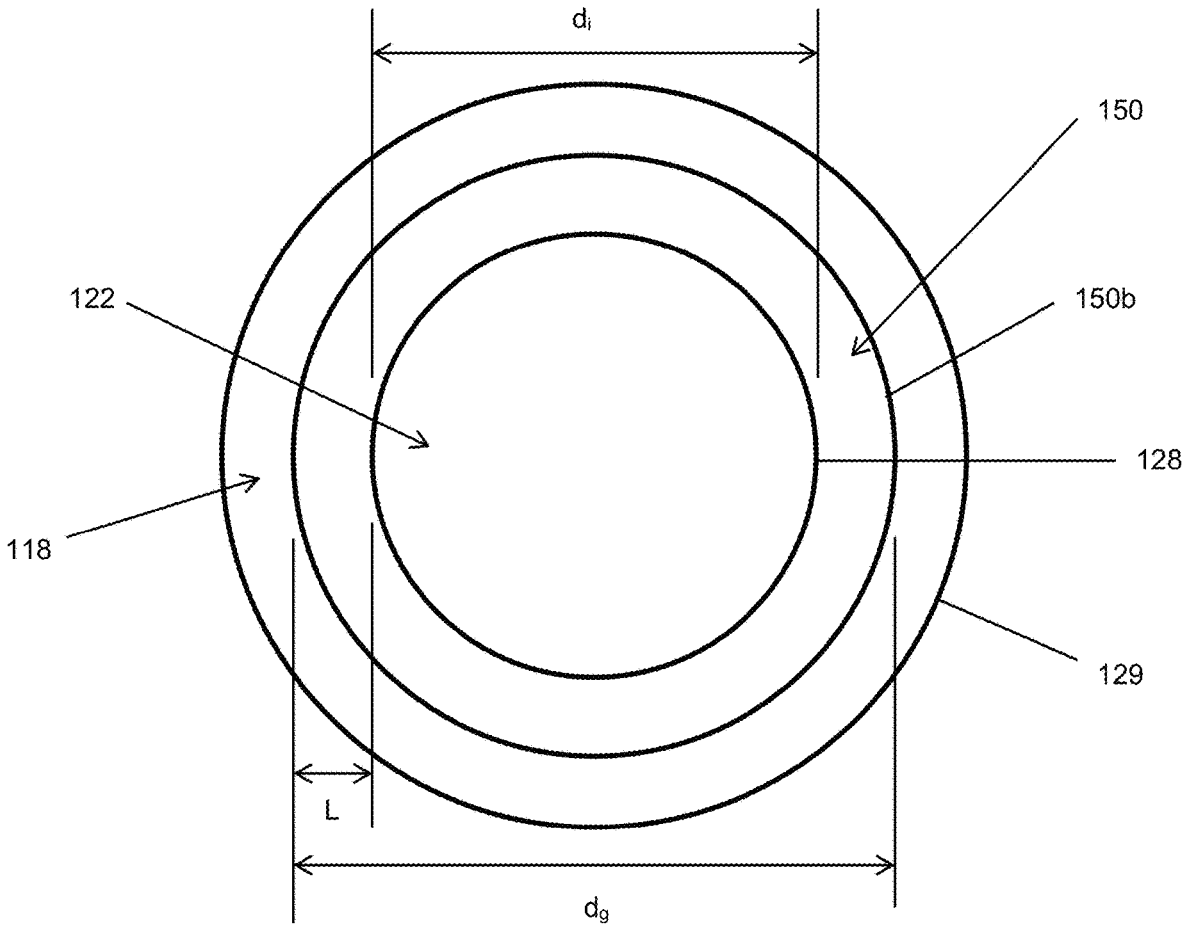
FIG. 4 is a section side elevation of the axial inlet along the line A-A in FIG. 2.

The quarter-wave equation has been adapted to apply the variables to the geometry of a groove 150 in an axial inlet 122, rather than a side duct connected to a main duct. In reference to FIGS. 3 and 4, the variables are as follows: $S_b$ is the area of the groove inlet 150*a*, calculated by $S_b=\pi d_i h$ where $d_i$ is the diameter of the duct portion 122*b* of the axial inlet 122 and h is the axial length of the groove 150; S is the cross-sectional area of the axial inlet 122, calculated by $$S = \pi\left(\frac{d_i}{2}\right)^2;$$

L is the depth of the groove 150, calculated by $$L = \frac{(d_g - d_i)}{2}$$

where $d_g$ is the diameter of the closed end surface 150*b* of the groove 150; k is a factor calculated by $$k = \frac{\omega}{c}$$

where ω is me frequency of the sound waves in the compressor 110 and c is the acoustic speed of the sound waves in the compressor 110; and IL is the insertion loss.

Typically, the compressor rotates at frequencies between approximately 80000 and 190000 rpm. The axial length of the groove h may be any appropriate value up to around 140 mm, such as around 5 mm to around 45 mm or around 10 mm to 35 mm. In further embodiments the axial length of the groove h is between around 5 mm and around 15 mm, for example, around 10 mm, or between around 30 mm and around 45 mm, for example, around 42 mm, e.g. around 41.65 mm. The depth of the groove L may be any appropriate value up to around 30 mm. In further embodiments the depth of the groove L is between around 5 mm and around 10 mm, for example, around 7 to 9 mm, e.g. around 7 mm or around 8.85 mm. The diameter of the duct portion $d_i$ may be any appropriate value up to around 180 mm. In further embodiments the diameter of the duct portion $d_i$ is between around 30 mm and around 50 mm, for example, around 40 to 45 mm, e.g. around 41.8 mm. The ratio (h:L) of the axial length of the groove h to the depth of the groove L is between around 1:1 and around 5:1. In further embodiments the ratio of the axial length of the groove h to the depth of the groove L is around 2:1 to 4:1, for example, around 1.5:1, e.g. around 1.43:1, or by way of a further example, around 4.7:1, e.g. around 4.71:1. The ratio ($d_i$:h) of the diameter of the duct portion $d_i$ to the axial length of the groove h is between around 1:1 and around 5:1. In further embodiments the ratio of the diameter of the duct portion $d_i$ to the axial length of the groove his around 1:1 to around 2:1, e.g. around 1.27:1, or around 3:1 to around 4.5:1, e.g. around 4.18:1. The ratio ($d_i$:L) of the diameter of the duct portion $d_i$ to the depth of the groove L is between around 4:1 and around 25:1. In further embodiments the ratio of the diameter of the duct portion $d_i$ to the depth of the groove L is around 5:1 to around 10:1, e.g. around 5.97:1, around 10:1 to around 15:1, or around 15:1 to 20:1, e.g. around 19.67:1.

The blade-pass noise can be reduced over 85% of the rotational frequencies of the compressor wheel. The average insertion loss is approximately 4 dB. Preferably the insertion loss is greater than 6 dB over 31% of the rotational frequencies of the compressor wheel. Preferably the insertion loss is 11 dB when the compressor wheel is rotating at a frequency of 140000 rpm.

The invention claimed is:

1. A compressor comprising:

a compressor housing; and a compressor wheel mounted in the compressor housing;

wherein an internal surface of the compressor housing defines an inlet port and an axial inlet which extends axially from the inlet port, the axial inlet comprising an annular groove for reducing blade pass noise of the compressor wheel rotating within the compressor housing, wherein the groove is located axially between the inlet port and the compressor wheel; and wherein the groove has a rectangular profile defined by a groove inlet, a closed end surface and axially opposing sidewalls.

2. The compressor according to claim 1, wherein the groove has a depth that is less than the distance between the internal surface of the compressor housing defining the axial inlet and an external surface of the compressor housing opposing the internal surface.

3. The compressor according to claim 1 wherein the groove has a constant profile around its circumference.

4. The compressor according to claim 1 wherein the groove has a variable profile around its circumference.

5. The compressor according to claim 4 wherein the depth of the groove varies around its circumference.

6. The compressor according to claim 1, wherein the groove inlet is radially aligned with the internal surface of the compressor housing.

7. The compressor according to claim 1 wherein the dimensions of the groove are defined by the equation:

$$IL = 10\log\frac{\left(\frac{S_B}{2S}\right)^2 + (cotkL)^2}{(cotkL)^2}$$

wherein IL is the reduction in blade pass noise, $S_b$ is the area of the groove inlet, S is a cross-sectional area of the axial inlet, L is the depth of the groove, k is a factor calculated by $$k = \frac{\omega}{c}$$

where ω is the frequency of the sound waves in the compressor in use and c is the acoustic speed of the sound waves in the compressor in use.

8. The compressor according to claim 7 wherein an average reduction in blade pass noise is approximately 4 dB.

9. The compressor according to claim 1, wherein the compressor wheel comprises an inducer end, and wherein the groove is located between an inlet port and the inducer end of the compressor wheel.

10. The compressor according to claim 1, wherein the axial inlet comprises a nozzle portion and a duct portion, and wherein the groove is located in the duct portion.

11. The compressor according to claim 10 wherein the nozzle portion is between an inlet port and the duct portion.

12. The compressor according to claim 1, wherein the groove comprises a plurality of grooves in the axial inlet.

13. The compressor according to claim 1, wherein an axial length of the groove (h) is between around 5 mm and 45 mm.

14. The compressor according to claim 1, wherein a depth of the groove (L) is between around 5 mm and around 10 mm.

15. The compressor according to claim 1, wherein a diameter of the axial inlet ($d_i$) is between 30 mm and 50 mm.

16. The compressor according to claim 1, wherein a ratio (h:L) of an axial length of the groove (h) to a depth of the groove (L) is between around 1:1 and around 5:1.

17. The compressor according to claim 1, wherein a ratio (di:h) of a diameter of the duct portion ($d_i$) to the axial length of the groove (h) is between around 1:1 and around 5:1.

18. The compressor according to claim 1, wherein a ratio (di:L) of a diameter of the duct portion ($d_i$) to the depth of the groove (L) is between around 4:1 and around 25:1.

19. A turbocharger comprising:

a turbine mounted on a first end of a shaft, and the compressor according to claim 1;

wherein the compressor wheel is mounted on a second end of the shaft opposing the first end of the shaft.

20. A compressor housing defining an axial inlet and a radially extending diffuser and a volute both arranged annularly around the axial inlet, and an intermediate surface defined between the axial inlet and the diffuser, wherein the intermediate surface is configured for blade tips of a compressor wheel to sweep across, wherein an internal surface of the axial inlet comprises an annular groove for reducing blade pass noise of the compressor wheel rotating within the compressor housing, wherein the groove is located axially between an inlet port and the intermediate surface, and wherein the groove has a rectangular profile defined by a groove inlet, a closed end surface and axially opposing sidewalls.

* * * * *